US006508180B1

(12) United States Patent
Weidemann et al.

(10) Patent No.: US 6,508,180 B1
(45) Date of Patent: Jan. 21, 2003

(54) METHOD AND DEVICE FOR POSITIONING A TRAIN

(76) Inventors: Hans-Jürgen Weidemann, Hinterm Esel 11, D-67346 Speyer (DE); Michael Baier, Sankt-Ingberter-Strasse 2, D-68309 Mannheim (DE); Klaus-Dieter Hilderbrandt, Holbinsenstrasse 2, D-74918 Angelbachtal (DE); Rolf Krouzilek, Laubacher Strasse 31, D-14197 Berlin (DE)

( * ) Notice: Subject to any disclaimer, the term of this patent is extended or adjusted under 35 U.S.C. 154(b) by 0 days.

(21) Appl. No.: 09/807,437

(22) PCT Filed: Jul. 8, 1999

(86) PCT No.: PCT/EP99/04825

§ 371 (c)(1),
(2), (4) Date: Jul. 17, 2001

(87) PCT Pub. No.: WO00/24627

PCT Pub. Date: May 4, 2000

(30) Foreign Application Priority Data

Oct. 23, 1998 (DE) ..... 198 49 023

(51) Int. Cl.[7] ..... B61K 7/00
(52) U.S. Cl. ..... 104/251; 104/252; 104/249
(58) Field of Search ..... 104/26.2, 249, 104/250, 251, 252; 188/33, 34, 38, 38.5, 60, 62, 63

(56) References Cited

U.S. PATENT DOCUMENTS 1,336,442 A * 4/1920 Read ..... 104/26.2
1,682,718 A * 8/1928 Merritt ..... 104/26.2
1,850,446 A * 3/1932 Camerota ..... 104/252
1,852,572 A * 4/1932 Howe ..... 104/26.2
1,878,234 A * 9/1932 Goodman ..... 104/250
3,217,159 A * 11/1965 Auer et al. ..... 104/26.2
3,253,142 A * 5/1966 Brown ..... 104/26.2
4,065,006 A 12/1977 Barry
5,388,525 A * 2/1995 Bodkin ..... 104/26.3

FOREIGN PATENT DOCUMENTS

| | | |
|---|---|---|
| DE | 1 530 281 | 10/1969 |
| DE | 29 25 905 | 1/1981 |
| DE | 295 13 265 | 12/1995 |
| EP | 0 795 452 A2 | 3/1997 |

* cited by examiner

*Primary Examiner*—Mark T. Le
(74) *Attorney, Agent, or Firm*—Howrey Simon Arnold & White

(57) ABSTRACT

A method for positioning railroad freight cars at specified positions while using robust positioning devices. One end of a train is prepositioned inside a comparatively wide area and a buffer device is activated. The locomotive pulls the train in a direction of travel until the activated buffer engages with a counter-buffer. The locomotive then exerts an additional tractive force so that the train is lengthened, whereby the front end of the first car, thus of the car coupled to the locomotive, is arranged in the area of a second counter-buffer device. A second buffer device is subsequently activated in a similar manner. The locomotive now decreases the tractive force so that the train is drawn together and so that the second buffer engages the second counter-buffer. The described positioning can be effected in the same manner by applying a pressure pretension onto the train.

15 Claims, 4 Drawing Sheets

METHOD AND DEVICE FOR POSITIONING A TRAIN

BACKGROUND OF THE INVENTION

1. Field of the Invention

The invention relates to a method and an apparatus for positioning a train, comprising a locomotive and a plurality of cars, which are coupled via pulling and pushing devices, with the interposition of spring forces. In particular, it relates to the use of freight cars in rail transport and the relative arrangement of such cars relative to predetermined stopping points or markings along a platform edge.

2. Description of the Related Art

The necessary accuracy of the positioning of the cars of a train depends on the method of loading and the nature of the freight. Thus, for example, in order to load cars with bulk material, it is sufficient to position the cars by eye. If, on the other hand, trucks or wheeled containers or other wheeled or track vehicles have to be run from platforms to the cars, or vice versa, transversely to the rails, it is necessary in certain cases to position the individual cars with tolerances of less than 10 cm in each case. This positioning is generally done by eye and with repeated correction by the personnel, working with the train driver.

According to the prior art, freight cars are positioned by manual shunting of the cars with a locomotive or shunting locomotive, using manual operation of the train's brakes. Buffers and brake shoes are also employed in sidings. No comparatively simple, substantially mechanical method or similar device for the automated positioning of all cars of the train, and hence of the train as a whole, is yet in use.

It is an object of the invention to provide a method and an apparatus of the type referred to initially by means of which it is possible to position all cars of the train with tolerances of, for example, less than 10 cm relative to a predetermined stationary marking, in order thus to enable automation of the operations of loading and unloading the cars, since such automation is dependent on such a degree of accuracy.

BRIEF SUMMARY OF THE INVENTION

This object is achieved, according to the invention, in that a first end of the train is previously positioned and a stop device is activated, in that the train is moved until the stop device interacts with a counter-stop, a force acting in the longitudinal direction of the train being applied, and is further elastically lengthened or shortened by utilizing the spring forces, in that a further stop device is activated at a second end of the train, and in that the force acting in the longitudinal direction is reduced and the train is moved under the influence of the spring forces against the direction in which the change of length is effected until the further activated stop device interacts with a further counter-stop, an elastic prestress being maintained.

The invention exploits the elastic lengthening and shortening of the train, which become possible as a result of pulling and pushing devices connected to the train via springs. The basic positioning of the train or chain of cars at equal intervals is achieved, by virtue of the defined, in other words stationary, arrangement of the two stop devices, with great accuracy, down to less than 1 cm, so that subsequently each individual car is positioned with an accuracy down to less than 5 cm. This arises as a result of the fixed tensioning of the train at both its ends via the stops and counter-stops provided there which is provided according to the invention.

The accuracy here is independent of the thermal expansion of the train. The force acting in the longitudinal direction of the train an be a tractive or compressive force, which is exercised primarily by the locomotive. It may however also be applied, in whole or in part, by a separate mechanical installation, for example via an electromechanically or hydraulically actuated piston/cylinder arrangement provided in the track bed.

The invention also relates to an apparatus for carrying out the method according to the invention. This is characterized in that one stop device is provided at least in the region of the two ends of the train, these stop devices interacting in the event of activation with one stationary counter-stop or one counter-stop arranged on the train in each case. If the counter-stops are arranged on the train, the stop devices are provided so as to be stationary. If, however, the stop devices are arranged on the train, the counter-stops for their part are arranged to be stationary.

According to the invention, each stop device has an extendable, in other words activatable, bolt which interacts with the counter-stop assigned to it. The latter is preferably provided with a damping device, which exerts its damping effect when the bolt impacts the stop device.

Further details, features and advantages of the invention are apparent from the description of a plurality of preferred examples of embodiment that follows and from reference to the diagrammatic drawing and the patent claims.

DESCRIPTION OF ILLUSTRATED EMBODIMENTS

Figure 1:
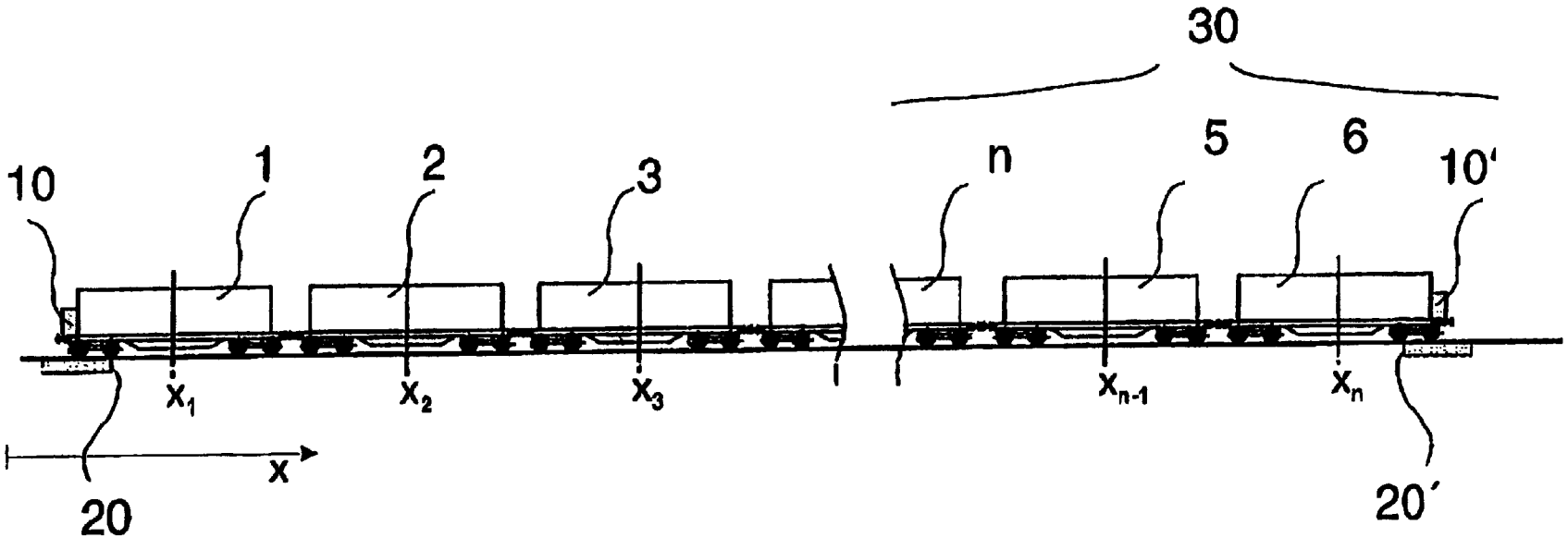
FIG. 1 shows a lateral view of a freight train comprising a plurality of cars.
Figure 2:
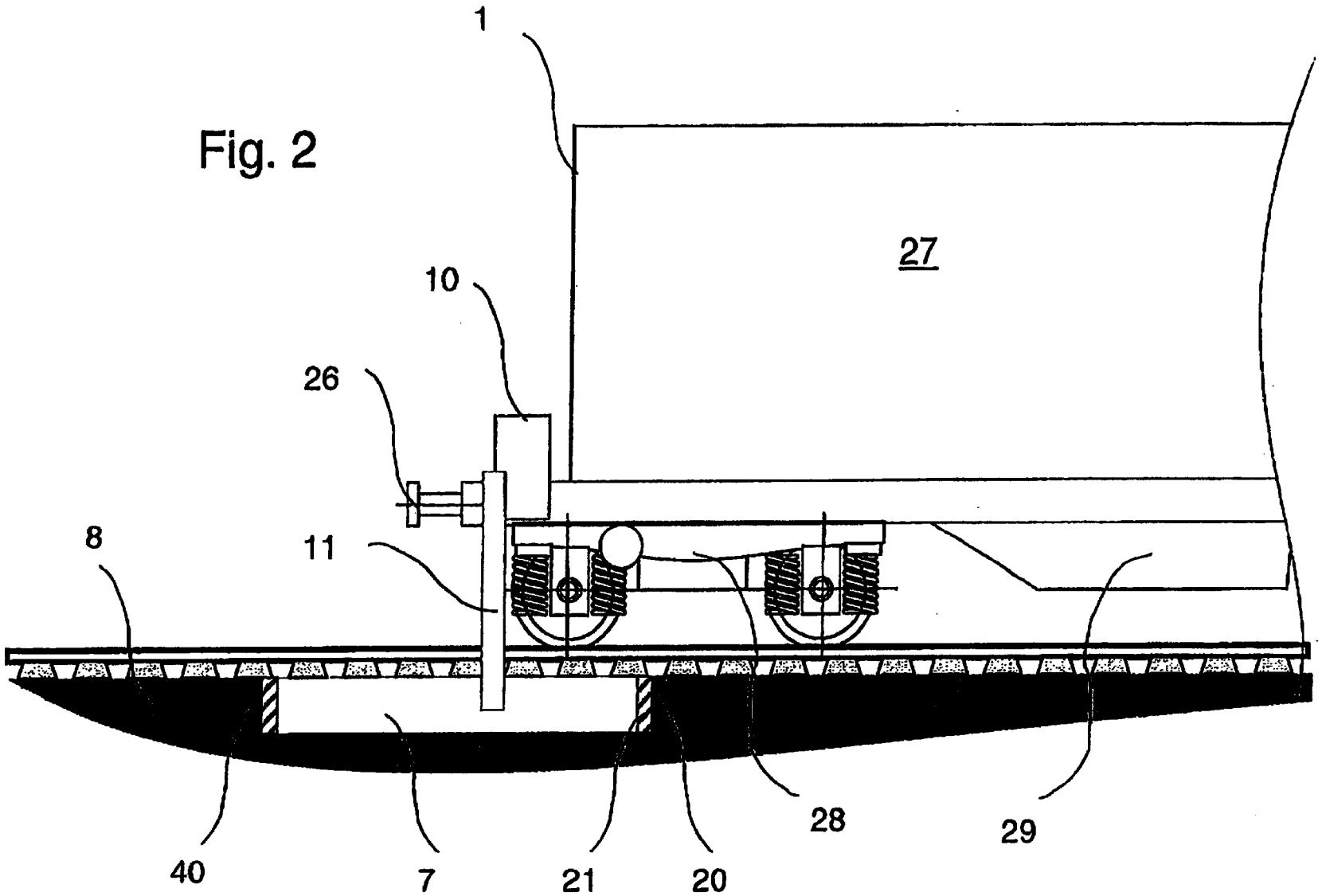
FIG. 2 shows an enlarged illustration of the free end of the left-hand freight car according to FIG. 1, to illustrate the positioning device with a stationary counter-stop according to the invention.

FIG. 1 shows a freight train or train 30 with cars 1 to 6. The invention is naturally not restricted to this number of cars, as is also indicated visually by the central cut-away freight car. The train 30 is positioned according to the invention. A locomotive has already been uncoupled and is not shown. The two cars 1 and 6 of the two ends of the train are each provided with a positioning device at their outer ends, which fundamentally comprises a stop device 10, 10' and a counter-stop 20, 20', cf. FIG. 2. In the example of embodiment shown, the activatable stop device 10 is arranged on the car 1 and the stop device 10', which is likewise movable but of mirror-image design, on the free end of the car 6. The components 10', 11' and 20' are not shown separately. The stationary counter-stops 20, 20' are each provided in a recess 7, 7' in the track bed 8. Of the car or carriage 1 according to FIG. 2, the view given in FIG. 2 shows its outer end with buffer 26, a freight recipient, for example a container 27, a running gear or bogey 28 and an underbody 29.

The operation according to the invention positioning the train 30 takes place with the assistance of the relatively simply and strongly constructed stop devices 10, 10' with their activatable, height-adjustable bolts 11, 11'.

The operation according to the invention for positioning the train 30 takes place as follows:

First, the locomotive driver uses the locomotive to stop the train 30 at a stationary mark provided at a predetermined distance from the recess 7. As a result, the stop 10 is positioned in the region of the recess 7. The mark is, for example, provided on the platform or in the track bed. The deviation of the train position from the mark may be 1 to 2 meters, as the recess 7 has a longitudinal extent of, for example, 4 meters.

On the car 1, the rear car, the bolt 11 is now activated and moves vertically downward, so that its lower end is positioned within the recess 7, in which the counter-stop 20 is also provided. The recess 7 may be limited by a frame. It has a length of approximately 4 meters, viewed in the longitudinal direction of the train 30, so that the position of the bolt 11 within the recess 7 is determined by the rough positioning of the train 30 as described.

After the bolt 11 of the car 1 has been lowered, the train 30 moves, in order to apply a tensile stress, approximately 2 to 3 meters in the direction of travel x, as a result of which the bolt 11 of the car 1 comes into contact with the damper 21 of the counter-stop 20. The locomotive then moves a short distance further and so tensions the springs of the train connections comprising hooks and eyes between the n cars, in the present case cars 1 to 6, plus the further cars indicated in the middle of the train 30 according to FIG. 1. The train 30, in other words the chain of cars, is thus pulled elastically apart. With modern standardized train units, the extent of the elastic movement apart of the cars is about 2 to 5 cm per coupling point.

As a result of the elastic lengthening of the train 30, the stop device 10' of the car 6, in other words the first car in the context of the locomotive (not shown)' and its direction of travel is above the recess 7' provided in the region of its stop unit and in front of the stop 20'. The bolt 11' of the stop device 10' of the car 6 is now unlatched or activated and moves vertically downward into the recess 7'. The locomotive reduces its tractive force, so that the chain of cars contracts. In this manner, the bolt 11' of the car 6 comes into engagement with the damper 21' of the counter-stop 20'. In this manner, the train 30 or chain of cars is slightly prestressed between the stops 20, 20', and the locomotive can be uncoupled from the train 30 if necessary or indicated.

The prestressing of the train of cars is taken up by the two stops or stop frames 20, 20'. The distances between the individual cars 1 to 6 within the set of cars are compensated by the fundamentally equal spring forces of the coupling parts (drawhooks and eyes), as a result of which the position of each individual car matches the desired geometrical ideal position to a tolerance of less than 5 cm. This is the requirement for the use of automatic loading and unloading apparatus, particularly in cases of combined rail/road transport, when truck trailers, containers or the like have to be transferred from freight cars to trucks or tractors and vice versa.

As mentioned, the stop device 10' with bolt 11', recess 7' and counter-stop 20' of the car 6, in other words the first car 6 of the train shown by definition, are not shown separately. They constitute the mirror image of what is shown in FIG. 2 and coincide in structure and function with the same elements of FIG. 2. The pulling devices, with drawhooks and eyes, for connecting the cars 1 to 6 are connected in a conventional manner via the abovementioned springs or spring forces to the individual cars 1 to 6, so that these springs are not shown separately.

The positioning of a train according to the invention, described above with reference to the application of a tractive prestress to the set of cars, can also be brought about, by kinematic reversal, by applying a compressive prestress which, again, is primarily generated by the locomotive of the train 30. This now travels counter to the direction of travel X shown in FIG. 1, so that, according to FIG. 2, the bolt 11 comes into contact with the further counter-stop 40 and rests there. As a result of the compressive force applied, elastic shortening of the train 30 takes place. In the same way, mutatis mutandis, as in the case of the elastic lengthening of the train 30, the bolt 11' of the stop device 10' of the car is activated so that it moves downward into the recess 7' and again comes into engagement with the damper 21' of the counter-stop 20'. The train is then under compressive prestress between the counter-stops 40 and 40', and the locomotive can be uncoupled from the train 30 if required.

Figure 3:
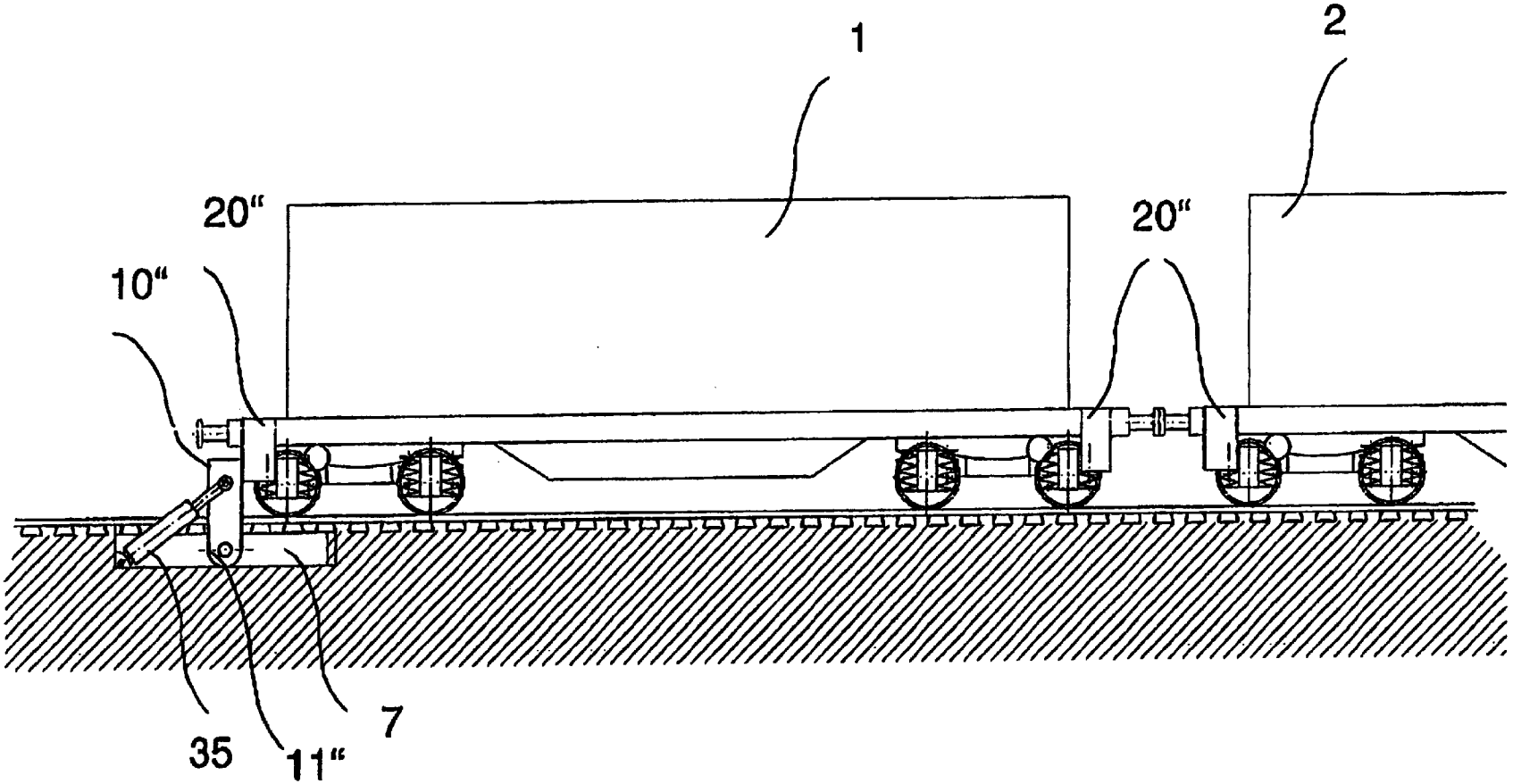
FIG. 3 shows a similar view to FIG. 2 with a counter-stop provided on a car.

In FIG. 3, the positioning device according to the invention is so designed that, reversing the mechanical principle according to FIG. 2, the stop device 10" is arranged to be stationary while the counter-stop 20" is arranged on the cars 1 to 6. In the example of embodiment shown in FIG. 3, a pivot lever 11" corresponds to the vertically adjustable bolt 11, 11' according to FIG. 2. It can be pivoted via a hydraulic cylinder 35 from a horizontal position into the vertical position shown in FIG. 3, where it interacts with the counter-stops 20" of the cars 1 to 6. In its horizontal position (not shown) the pivot lever 11" is arranged in the recess 7 of the track bed, in which case it cannot come into interaction with the counter-stops 20, 20', 20". The cylinder arrangement 35, to facilitate the pivot movement of the pivot lever 11", is pivotably mounted as shown both on the latter and in the region of the recess 7.

Figure 4:
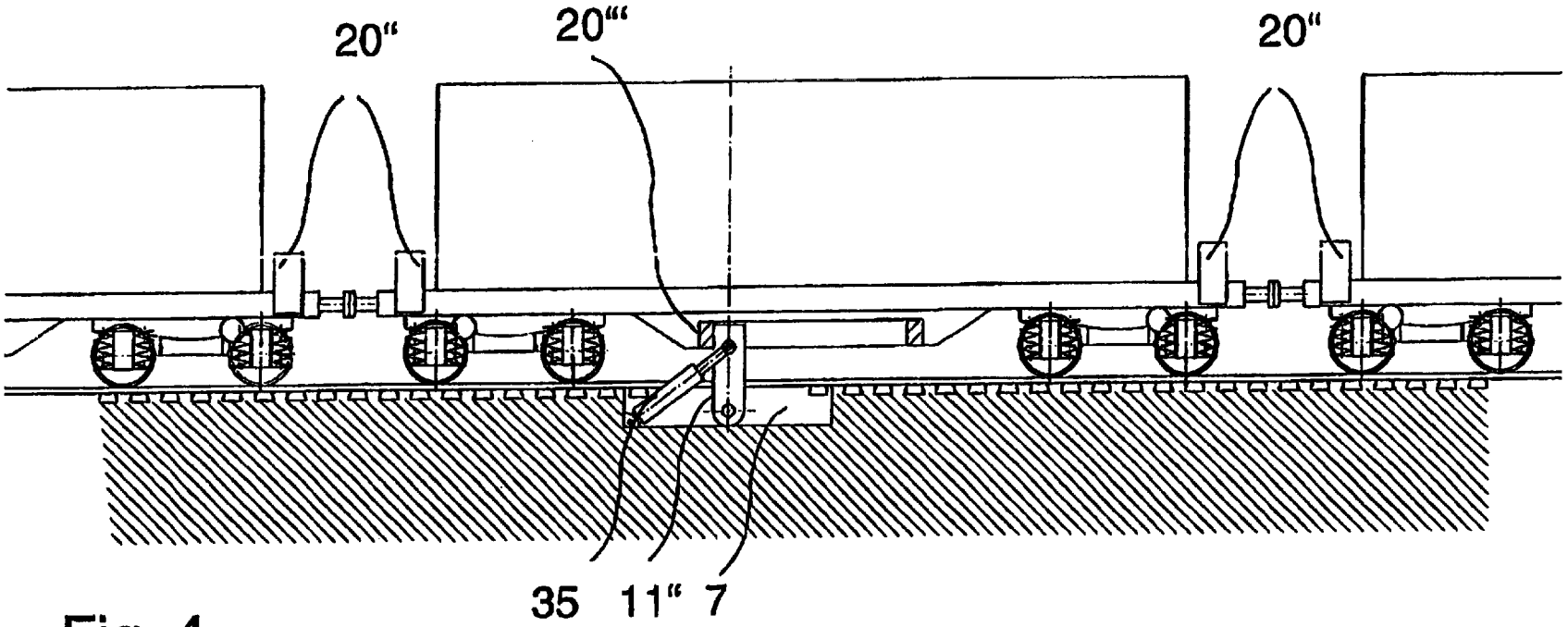
FIG. 4 shows a train with a counter-stop additionally provided, for example, at the center of the train.

FIG. 4 shows the same positioning device as in FIG. 3. In this case, however, it is provided as an additional positioning device, approximately in the middle of the train to be positioned. In addition to the two positioning devices described at the beginning and end of the train, one or more positioning devices according to FIG. 4 contribute to an increased precision of the positioning operation.

What is claimed is:

1. A method for positioning a train comprising a locomotive and a plurality of cars which are coupled via pulling and pushing devices with the interposition of spring forces, the method comprising:

positioning a first end of the train at a predetermined first location;

activating a first stop device at the first end of the train;

moving the train until the first stop device interacts with a first counter-stop;

applying a force acting in the longitudinal direction of the train to elastically lengthen or shorten the train by utilizing the spring forces;

activating a second stop device at a second end of the train; and reducing the force acting in the longitudinal direction so that the train moves under the influence of the spring forces against the direction in which the change of length is effected until the second stop device interacts with a second counter-stop.

2. The method as claimed in claim 1, wherein the force acting in the longitudinal direction of the train is a tractive or compressive force.

3. The method of claim 1, wherein the train runs on a pair of parallel rails and wherein the step of activating a first stop device comprises engaging the first stop device with a recess formed beneath the parallel rails to inhibit movement of the first end of the train.

4. The method according to claim 1, wherein elastic prestress of the train is maintained after reducing the force acting in the longitudinal direction.

5. The method according to claim 1, wherein the each of the first and second stop devices includes an extendable bolt.

6. The method according to claim 1, comprising the additional step of positioning a third stop device on the train at a location intermediate the first and second ends of the train to increase precision of the train positioning.

7. An apparatus for positioning a train having a plurality of cars connected via couplings, the train running on a pair of parallel rails, the apparatus comprising:

a first stop device provided at a first end of the train; and a second stop device provided at a second end of the train, wherein the first and second stop devices each interact with a respective recess formed beneath the rails to inhibit movement of the first and second ends of the train respectively.

8. The apparatus of claim 7, wherein the train is maintained in compression or tension when the first and second stop devices are engaged to interact with a respective recesses.

9. The apparatus of claim 7, wherein the first stop device comprises an extendable member movable into the respective recess.

10. The apparatus of claim 7, further comprising counter-stops within each of the recesses, each counter-stop including a damping device.

11. The apparatus according to claim 7, further comprising a third stop device on the train at a location intermediate the first and second stop devices for stopping the train by engaging a corresponding recess formed beneath the parallel rails.

12. The apparatus according to claim 11, further comprising a counter-stop within the corresponding recess, the corresponding recess having a damping device therein.

13. An apparatus for positioning a train having a plurality of cars connected via couplings, the train running on a pair of parallel rails, the apparatus comprising:

a first stop device provided at a position adjacent a first end of the train; and a second stop device provided at a position adjacent a second end of the train, wherein the first and second stop devices each interact with a respective counter-stop on a first and second end of the train respectively to inhibit movement of the first and second ends of the train.

14. The apparatus of claim 13, wherein the first stop device includes an extendable member that engages with the first counter-stop.

15. The apparatus of claim 14, wherein the first stop device comprises a hydraulic cylinder that pivots the extendable member.

* * * * *